US005207033A

United States Patent [19]

Sells

[11] Patent Number: 5,207,033

[45] Date of Patent: May 4, 1993

[54] EVAPORATION TRAY

[76] Inventor: Gary L. Sells, 16250 Petro Dr., Mishawaka, Ind. 46544

[21] Appl. No.: 824,400

[22] Filed: Jan. 23, 1992

[51] Int. Cl.[5] ..... E04B 13/00

[52] U.S. Cl. ..... 52/14; 428/178; 52/199; 52/407; 52/792

[58] Field of Search 52/97, 209, 533, 14, 22; 428/178, 116; 206/430, 431

[56] References Cited

U.S. PATENT DOCUMENTS

| | | | |
|---|---|---|---|
| 2,397,345 | 3/1946 | Gilleland | 52/407 |
| 3,160,987 | 12/1964 | Pinkley | 52/407 |
| 3,525,663 | 8/1970 | Hale | 52/792 |
| 3,742,663 | 7/1973 | Duskin | 52/792 |
| 3,834,487 | 9/1974 | Hale | 428/178 |
| 3,938,963 | 2/1976 | Hale | 428/178 X |
| 4,937,990 | 7/1990 | Paquette | 52/199 |
| 4,977,714 | 12/1990 | Gregory | 52/407 X |

*Primary Examiner*—Richard E. Chilcot, Jr.
*Assistant Examiner*—Beth A. Aubrey
*Attorney, Agent, or Firm*—James D. Hall

[57] ABSTRACT

An evaporative tray composed of polyether type urethane foam used for protecting buildings from the ingress of moisture through roof vents. The tray has convoluted fingers projecting upwardly and spacedly separated to form cups between adjacent fingers for collecting the moisture.

11 Claims, 5 Drawing Sheets

EVAPORATION TRAY

BACKGROUND OF THE INVENTION

This invention relates to a device for collecting and then evaporating moisture underneath roof vents. In many types of roof vents, moisture from snow, rain or sleet can enter into the attic cavity through the openings in the vents. This moisture can seep onto the underlying wall or ceiling causing damage.

SUMMARY OF THE INVENTION

This invention prevents wind driven moisture entering roof vents from collecting on the structures underneath the roof by placing an evaporation tray underneath the vent. The evaporation tray has upwardly protruding convoluted fingers. The material of the evaporation tray is preferably composed of polyether type urethane foam. This shape of the tray allows the water to collect within the tray convolutions and then evaporate.

It is an object of this invention to protect the ceiling insulation and other material underneath the rooftop from moisture driven into the roof vents.

It is another object of this invention to provide a tray for evaporating collected moisture from under a roof.

Other objects will become apparent upon a reading of the following description.

DETAILED DESCRIPTION OF THE PREFERRED EMBODIMENTS

The preferred embodiments herein described are not intended to be exhaustive or to limit the invention to the precise forms disclosed. They are chosen and described to explain the principles of the invention and its application and practical use so that others skilled in the art may follow its teachings.

Figure 2:
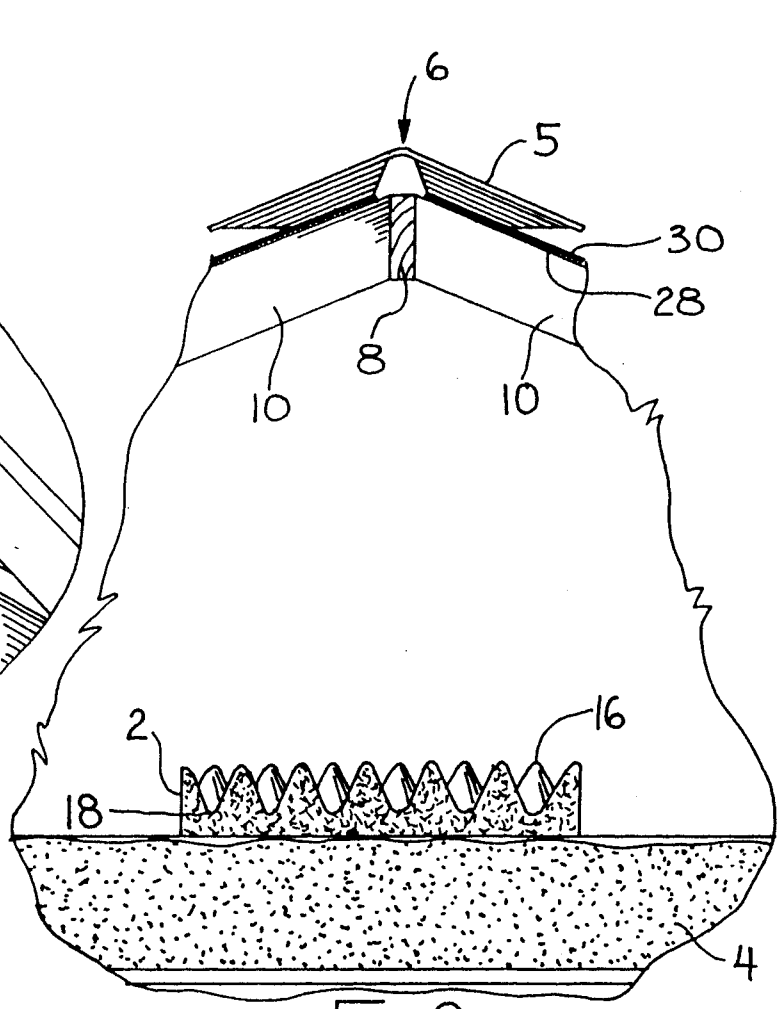
FIG. 2 is a fragmented sectional view taken along lines 2—2 of FIG. 1 and shows the roof sheathing, covering, and vent.
Figure 1:
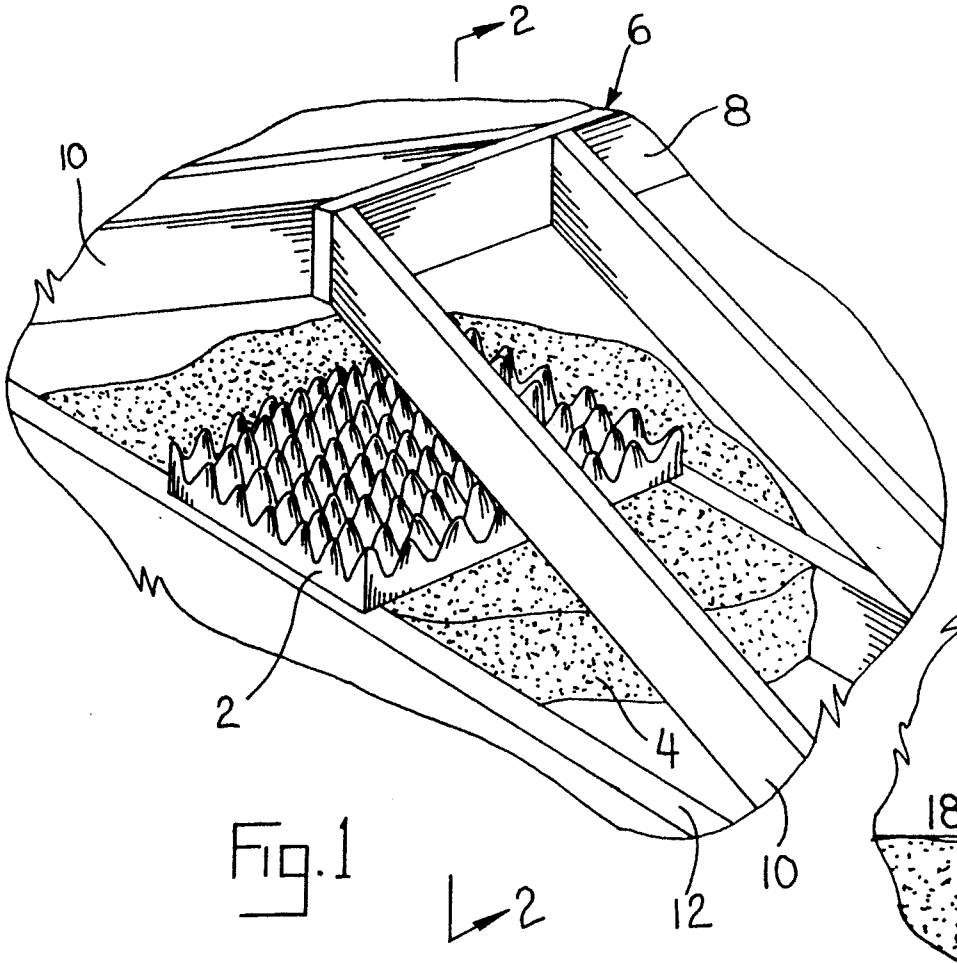
FIG. 1 is a fragmentary perspective view of the evaporation tray located below the ridge vent of a roof shown with the roof sheathing and covering removed for illustrative purposes.

Referring to the drawings, FIGS. 1 and 2 show the evaporation tray 2 installed on top of the insulation 4 and underneath a ridge vent 5 of the roof 6 of a building. The vent which is secured upon sheathing 28 covered by shingles 30 has a pair of elongated vent parts. A plurality of vent openings extend transversely through each vent part from one side edge to the other side edge. The ridge of the roof has a longitudinal vent opening formed therein and the vent part is located at each side of the ridge opening with its lower edge in contact with the roof. Each vent part inner edge partially overlies the longitudinal vent opening. The two vent halves meet at their inner edges to form an apex in alignment with the longitudinal vent opening. The ridge or center board 8 is connected to a plurality of longitudinally spaced inclined rafters 10. A plurality of ceiling joists 12 extending laterally is located spacedly underneath rafters 10. Insulation 4 is located between the ceiling joists 14.

The evaporation tray 2 is placed upon the insulation 4 and is generally centered underneath the ridge board 8. The evaporation tray's length is generally equal to the distance between adjacent ceiling joists 14. The tray 2 is preferably formed of a polyether type urethane foam material having a density of 22–24 kg/m$^3$. The foam is able to absorb and contain liquid water. Tray 2 includes a plurality of convoluted upwardly extending fingers 16. Fingers 16 also act to reduce the air velocity causing the wind blown moisture to fall on the area of the evaporation tray. The fingers act to accelerate the evaporation of the moisture within the evaporation tray. Cups or indentations 18 separate fingers 16. These indentations aid the retention of moisture when snow turns to liquid. Tray 2 is located under the ridge mounted roof vent 5, or if a wall mounted vent is used, tray 2 would be placed against the wall under the vent location, such as against the gable and wall below a gable end ventilator.

Figure 3:
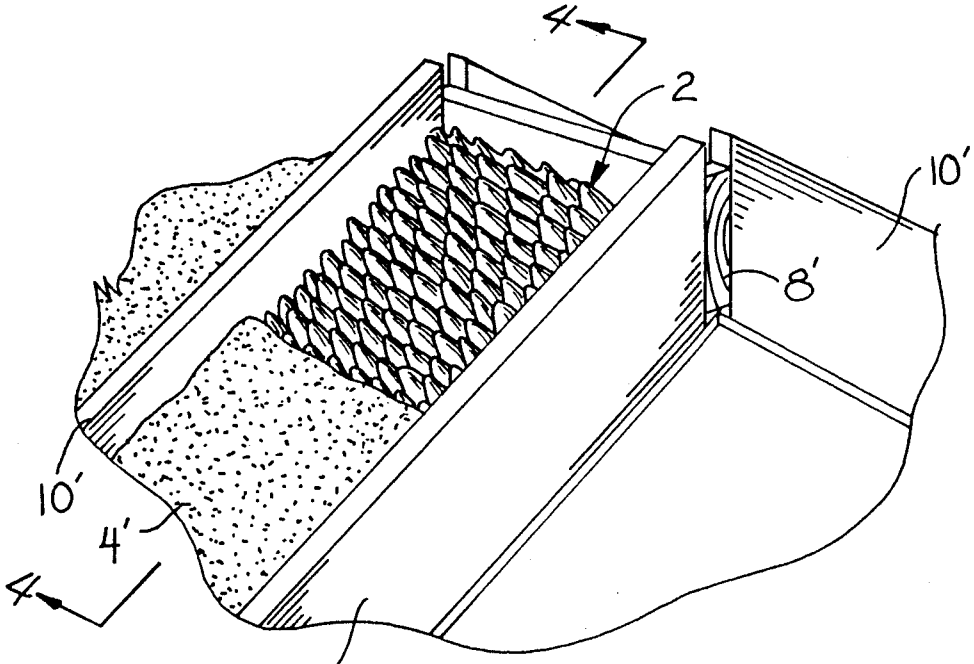
FIG. 3 is a fragmented perspective view of the evaporation tray fitted between the rafters underneath a ridge vent of a cathedral ceiling.
Figure 4:
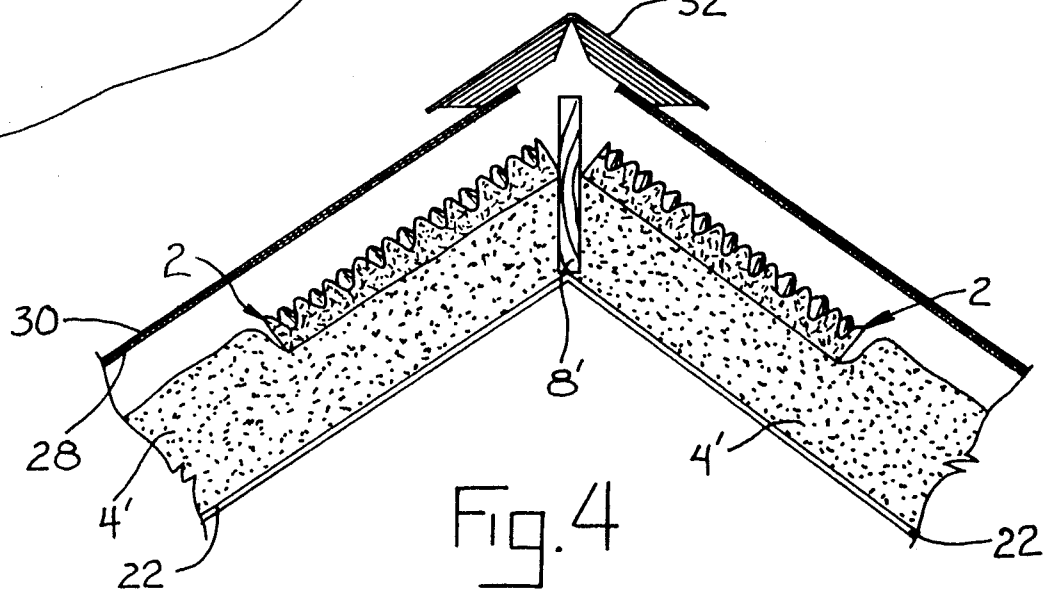
FIG. 4 is a fragmented sectional view taken along lines 4—4 of FIG. 3 and showing the roof sheathing, covering and vent.
Figure 9:
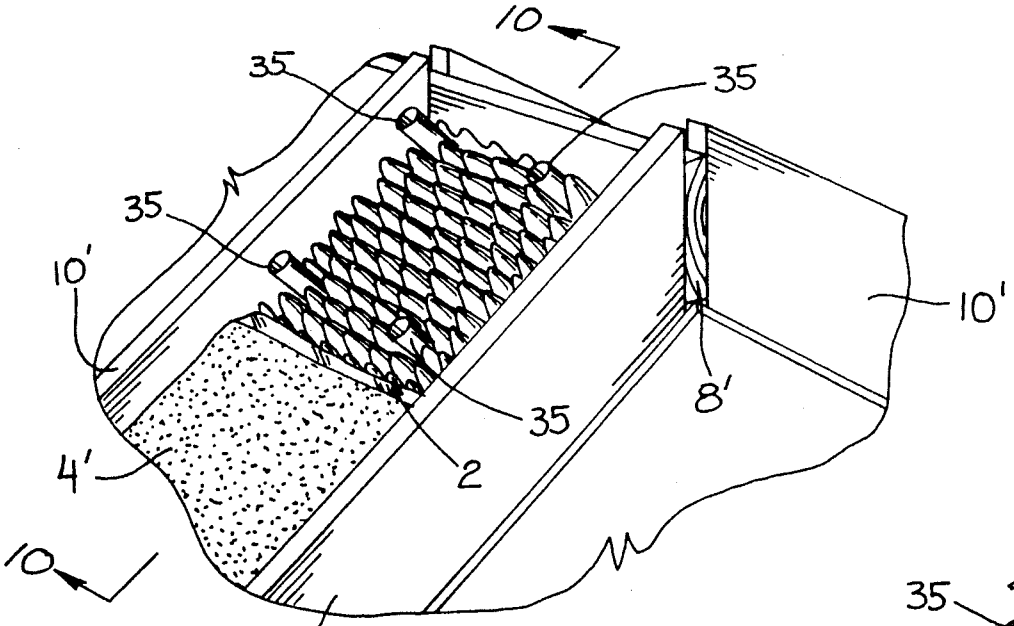
FIG. 9 is a view similar to FIG. 3 and including spacers.
Figure 10:
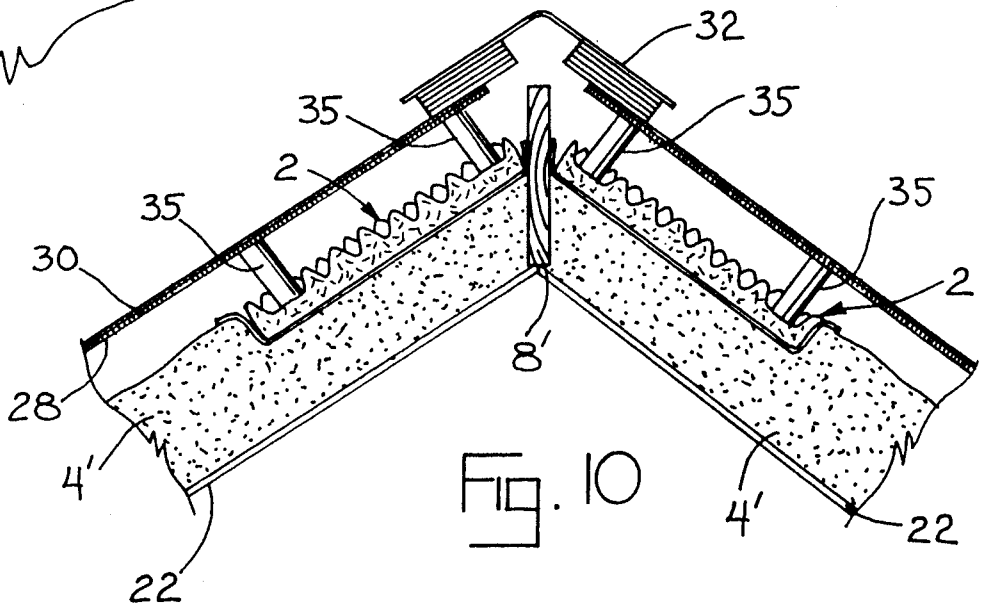
FIG. 10 is a view similar to FIG. 4 and including spacers.

FIGS. 3 and 4 show evaporation trays 2 installed between two longitudinally spaced rafters 10' in a cathedral ceiling. Wall board 22 is nailed over rafters 10' at their bottom edges. Insulation 4' of a suitable thickness covers wall board 22. Roof sheathing 28 covers the rafters 10' and shingles 30 are applied over the sheathing. A ridge vent 32 is secured over the shingles and centered over the ridge board 8'. As seen in FIGS. 9 and 10, a plurality of hollow tubular spacers 35 may be fitted between the evaporation tray 2 and roof sheathing 28 to compress the tray and insulative material 4' to ensure that at least 2" of air space is present for proper air flow out of the ridge vent 32.

Figure 6:
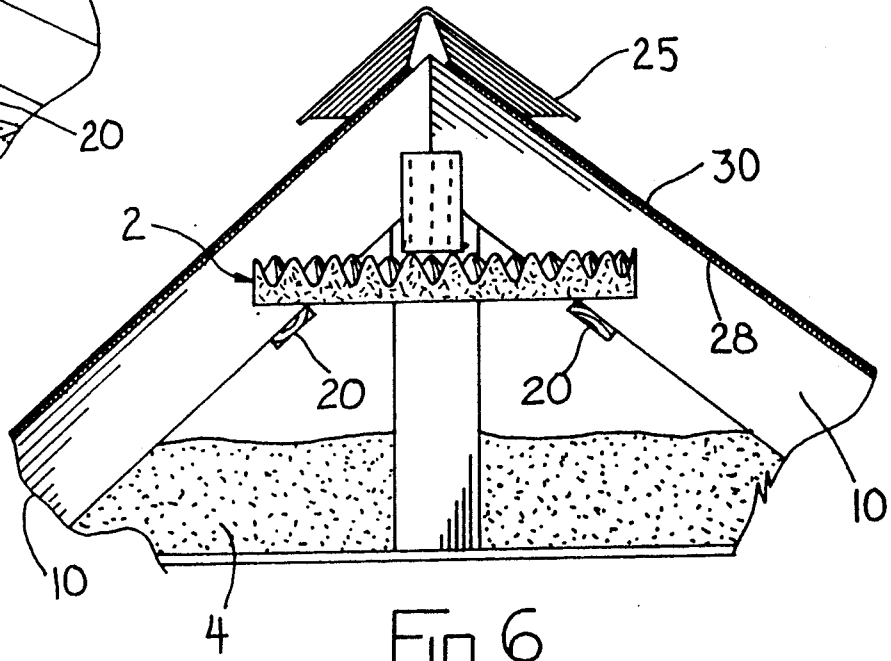
FIG. 6 is a fragmented sectional view taken along lines 6—6 of FIG. 3 and showing the roof sheathing, covering and vent.
Figure 5:
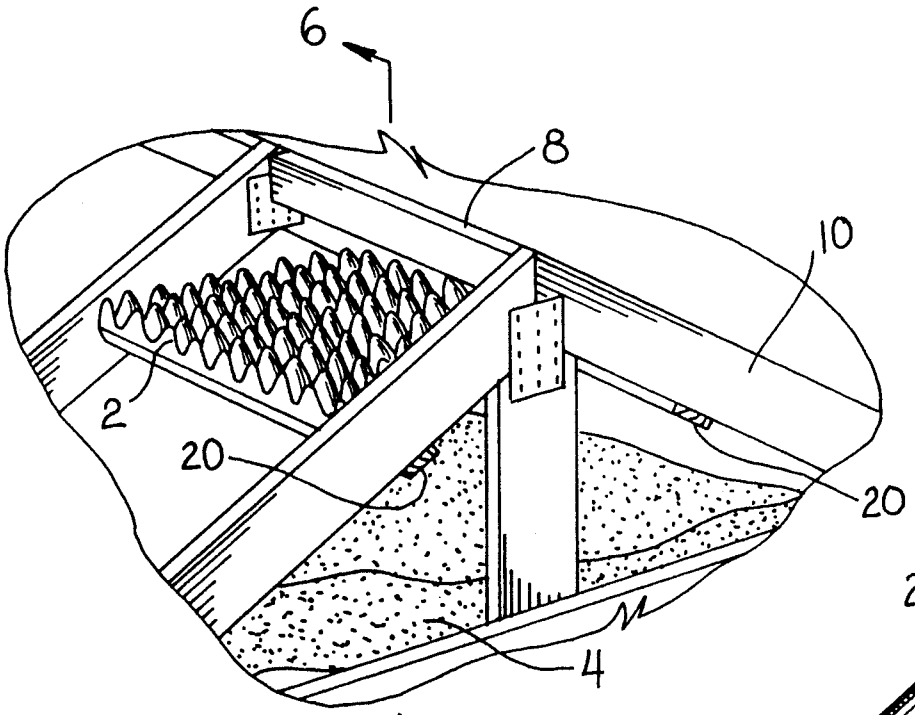
FIG. 5 is a fragmented perspective view of the evaporation tray installed underneath the ridge vent of the attic and fastened by wood lath.

FIGS. 5 and 6 show the evaporation tray 2 supported upon wood lath 20. Lath 20 extends longitudinally and is secured underneath rafters 10. Vent 25 is mounted over center board 8 with tray 2 located under the vent.

Figure 7:
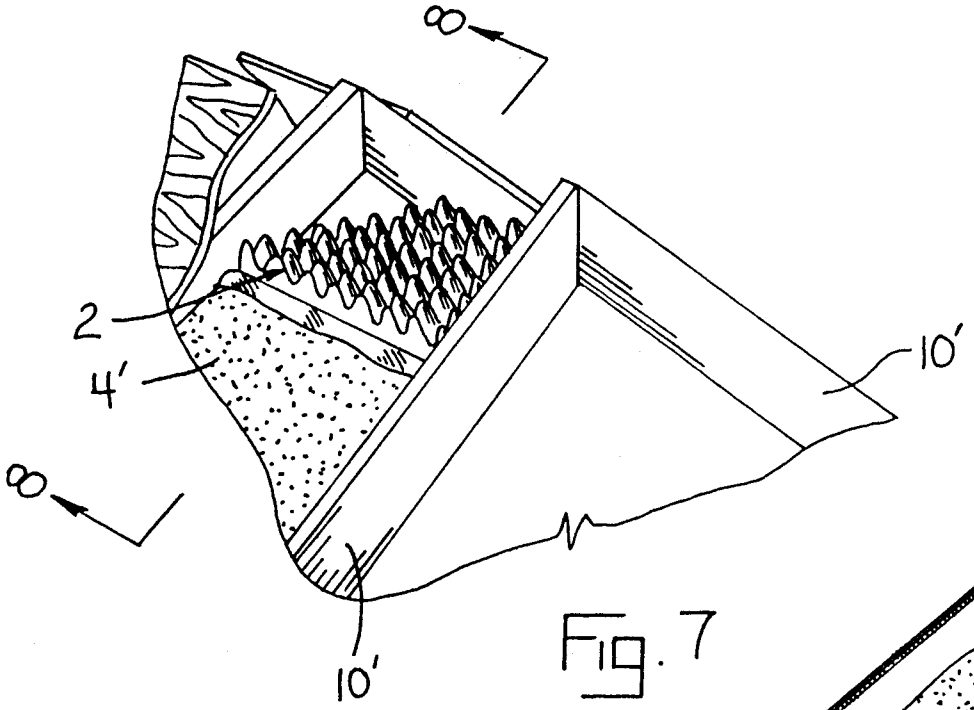
FIG. 7 is a fragmentary perspective view of the evaporation tray centered directly underneath the ridge vent of a cathedral ceiling.
Figure 8:
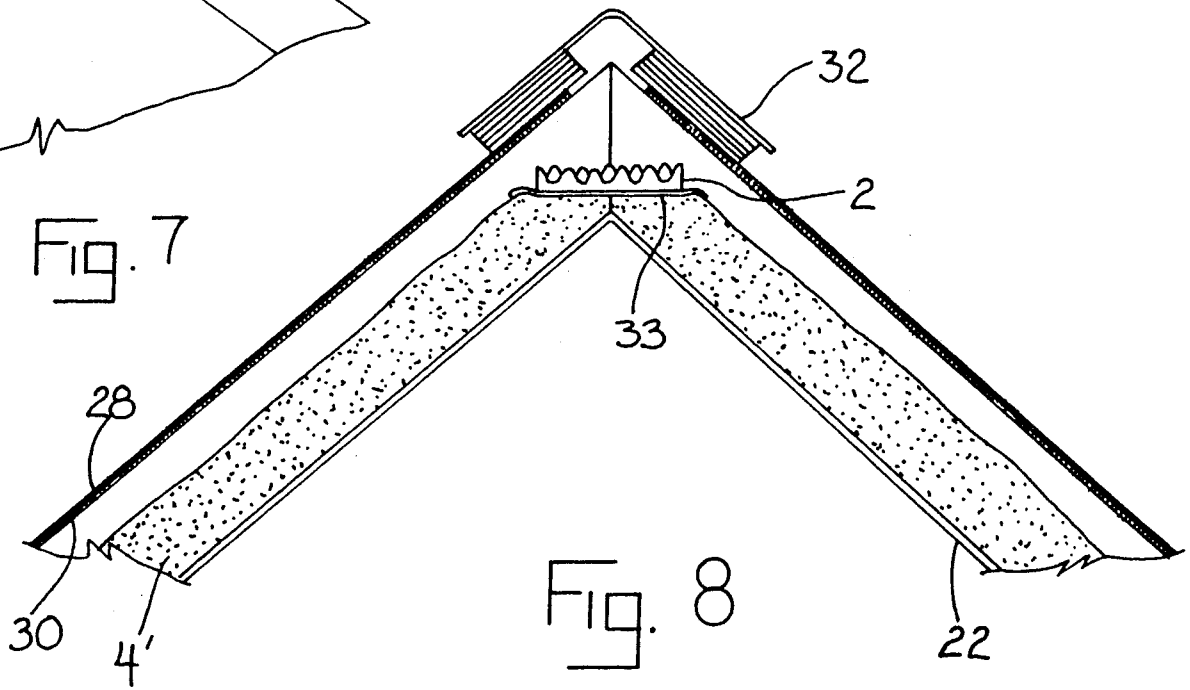
FIG. 8 is a fragmented sectional view taken along lines 8—8 of FIG. 7 and showing the roof sheathing, covering, and vent.

FIGS. 7 and 8 illustrate an evaporation tray 2 installed in a cathedral ceiling of similar construction as FIGS. 3 and 4 except with no ridge board. A moisture proof member 33, such as a plastic sheet, is shown attached to the bottom surface of the evaporation tray to aid moisture containment.

The evaporation tray can also be installed underneath a turbine vent, roof vent, or beside any wall or gable end louver or ventilator. A number of evaporation trays placed adjacent to each other may be installed underneath these vents to collect and evaporate more moisture.

It is understood that the above description does not limit the invention to the given details, but may be modified within the scope of the following claims.

I claim:

1. In combination a water collection device with a building structure having a roof, said roof having vent means for allowing air to flow into and out of area underneath said roof, said water collection device located adjacent said vent means within said area, said device having finger-like extensions projecting upwardly and defining convolution means for collecting and aiding in evaporating said water passing through said vent means into said area.

2. The combination of claim 1 wherein said convolution means defines a plurality of cup-shaped depressions located between said extensions.

3. The combination of claim 1, wherein said building structure includes a plurality of ceiling joists underneath said roof, said water collection device resting upon said ceiling joists.

4. The combination of claim 1, wherein said building structure includes a plurality of ceiling joist members, insulation between said joist members, said water collection device resting upon said insulation.

5. The combination of claim 1 wherein said roof includes a plurality of rafters, said water collection device resting between said rafters.

6. The combination of claim 5 including a covering over said rafters, insulative material placed between said rafters upon said covering, said water collection device resting upon said insulative material.

7. The combination of claim 6 and means for compressing said water collection device and said insulative material to ensure proper air flow out of said vent means.

8. The combination of claim 7 wherein said means for compressing said water collection device and said insulative material to ensure proper air flow out of said vent means includes at least one spacer placed between said water collection device and roof.

9. The combination of claim 1 wherein said water collection device includes a moisture proof membrane attached to its bottom surface to aid moisture containment.

10. The combination of claim 1 wherein said roof includes a plurality of upwardly inclined opposing rafters forming a ridge, lath extending between opposing rafters, said water collection device resting upon said lath.

11. The combination of claim 1 including a plurality of water collection devices placed adjacent said vent means.

* * * * *